US008524042B2

(12) United States Patent
Zhang et al.

(10) Patent No.: US 8,524,042 B2
(45) Date of Patent: Sep. 3, 2013

(54) METHOD OF TREATING PAPER FORMING WIRE SURFACE

(75) Inventors: Fushan Zhang, Hockessin, DE (US); Tien-Feng Ling, Newark, DE (US)

(73) Assignee: Hercules Incorporated, Wilmington, DE (US)

( * ) Notice: Subject to any disclaimer, the term of this patent is extended or adjusted under 35 U.S.C. 154(b) by 39 days.

(21) Appl. No.: 13/214,708

(22) Filed: Aug. 22, 2011

(65) Prior Publication Data

US 2012/0043040 A1 Feb. 23, 2012

Related U.S. Application Data

(60) Provisional application No. 61/376,051, filed on Aug. 23, 2010.

(51) Int. Cl.

| | |
|---|---|
| ***D21F 1/30*** | (2006.01) |
| ***D21H 21/02*** | (2006.01) |
| ***D21H 17/57*** | (2006.01) |
| ***D21H 17/44*** | (2006.01) |
| ***D21H 17/54*** | (2006.01) |

(52) U.S. Cl.
USPC ..... 162/199; 162/164.6; 162/168.2

(58) Field of Classification Search
USPC ..... 162/199, 164.6, 168.2
See application file for complete search history.

(56) References Cited

U.S. PATENT DOCUMENTS

| | | | | |
|---|---|---|---|---|
| 2,865,817 | A * | 12/1958 | Clausen | 201/39 |
| 3,150,035 | A * | 9/1964 | Eddy | 162/199 |
| 4,190,491 | A | 2/1980 | Drennen et al. | |
| 4,228,277 | A | 10/1980 | Landoll | |
| 4,710,267 | A | 12/1987 | Elsby et al. | |
| 4,765,867 | A | 8/1988 | Dreisbach et al. | |
| 4,783,240 | A | 11/1988 | Kurokawa et al. | |
| 4,871,424 | A | 10/1989 | Dreisbach et al. | |
| 4,923,566 | A | 5/1990 | Shawki et al. | |
| 4,956,051 | A | 9/1990 | Moreland | |
| 4,995,944 | A * | 2/1991 | Aston et al. | 162/199 |
| 5,135,613 | A * | 8/1992 | Waldmann | 162/199 |
| 5,223,097 | A | 6/1993 | Hassler | |
| 5,246,547 | A | 9/1993 | Finck et al. | |
| 5,246,548 | A | 9/1993 | Aston et al. | |
| 5,300,194 | A | 4/1994 | Welkener et al. | |
| 5,368,694 | A | 11/1994 | Rohlf et al. | |
| 5,723,021 | A | 3/1998 | Nguyen | |
| 6,054,511 | A | 4/2000 | Angerer et al. | |
| 2004/0231816 | A1 | 11/2004 | Van De Steeg et al. | |
| 2006/0048908 | A1 | 3/2006 | Wang et al. | |
| 2008/0029231 | A1 | 2/2008 | Gu et al. | |
| 2010/0147476 | A1 * | 6/2010 | Gu et al. | 162/164.6 |
| 2010/0170646 | A1 | 7/2010 | Wang et al. | |

FOREIGN PATENT DOCUMENTS

| | | |
|---|---|---|
| EP | 2157237 | 3/2010 |
| WO | 2010059703 | 5/2010 |

OTHER PUBLICATIONS

International Search Report, PCT/US2011/048619, dated Feb. 9, 2012, p. 3.

* cited by examiner

*Primary Examiner* — Eric Hug
(74) *Attorney, Agent, or Firm* — Joanne Rossi; Shaorong Chen; Michael J. Herman

(57) ABSTRACT

A method for inhibiting resinous and sticky substances from filling or forming deposits on or within papermaking forming wire, by applying to said wire an effective inhibiting amount of a composition comprising at least one cationic agent selected from the group consisting of (a) cationic polyureas, (b) hydrophobically modified cationic polymers, (c) alkylammonium or/and alkylimidazolium salts, and optionally at least one nonionic amphiphilic copolymer selected from (i) hydrophobically modified polyethylene glycols], (ii) hydrophobically modified cellulose ethers, (iii) copolymers of vinyl alcohol and vinyl alkonate, (iv) polyoxyalkylene block copolymers, and (v) hydrophilically modified polydimethylsiloxanes.

13 Claims, No Drawings

METHOD OF TREATING PAPER FORMING WIRE SURFACE

This Application claims priority of U.S. Provisional Application No. 61/376,051, filed Aug. 23, 2010, the entire contents of which are herein incorporated by reference.

FIELD OF THE INVENTION

The invention relates to compositions and a method for inhibiting resinous and sticky substances from deposition on papermaking equipment surfaces, especially on paper forming wire, by applying to the equipment surface an effective inhibiting amount of a composition comprising a cationic agent selected from the group consisting of (a) cationic polyureas, (b) hydrophobically modified cationic polymers, (c) alkylammonium or/and alkylimidazolium salts, and optionally the composition further comprising at least one nonionic amphiphilic polymer.

BACKGROUND OF THE INVENTION

The deposition of organic contaminants (i.e., pitch and stickies) on surfaces in the papermaking process is well known to be detrimental to both product quality and the efficiency of the papermaking process. Some contaminating components occur naturally in wood and are released during various pulping and papermaking processes. Two specific manifestations of this problem are referred to as pitch (primarily natural resins) and stickies (synthetic contaminants from recycled paper). Pitch and stickies have the potential to cause problems with deposition, quality, and efficiency in the process as mentioned above.

The term "pitch" can be used to refer to deposits composed of organic constituents which may originate from these natural resins, their salts, as well as coating binders, sizing agents, and defoaming chemicals which may be found in the pulp. In addition, pitch deposits frequently contain inorganic components such as calcium carbonate, talc, clays, titanium and related materials.

"Stickies" is a term that has been increasingly used to describe deposits that occur in the systems using recycled fiber. These deposits often contain the same materials found in "pitch" deposits in addition to adhesives, hot melts, waxes, coatings, and inks.

The deposition of organic contaminants, such as pitch and stickies, can be detrimental to the efficiency of a pulp or paper mill causing both reduced quality and reduced operating efficiency. Organic contaminants can deposit on process equipment in papermaking systems resulting in operational difficulties in the systems. The deposition of organic contaminants on consistency regulators and other instrument probes can render these components useless. Deposits on screens can reduce throughput and upset operation of the system. This deposition can occur not only on metal surfaces in the system, but also on plastic and synthetic surfaces such as machine wires, felts, foils, Uhle boxes and head box components.

From a physical standpoint, "pitch" deposits have usually formed from microscopic particles of adhesive material (natural or man-made) in the stock which accumulate on papermaking or pulping equipment. These deposits can readily be found on stock chest walls, paper machine foils, Uhle boxes, paper machine wires, wet press felts, dryer felts, dryer cans, and calendar stacks. The difficulties related to these deposits included direct interference with the efficiency of the contaminated surface, therefore, reduced production, as well as holes, dirt, and other sheet defects that reduce the quality and usefulness of the paper for operations that follow like coating, converting or printing.

From a physical standpoint, "stickies" have usually been particles in the stock which originate from the recycled fiber. These deposits tend to accumulate on many of the same surfaces that "pitch" can be found on and causes many of the same difficulties that "pitch" can cause. The most severe "stickies" related deposits however tend to be found on paper machine wires, wet felts, dryer felts and dryer cans.

Historically, the subsets of the organic deposit problems, "pitch" and "stickies", have manifested themselves separately, differently and have been treated distinctly and separately. This was true because mills usually used only virgin fiber or only recycled fiber. Often very different treatment chemicals and strategies were used to control these separate problems. However, current trends are for increased mandatory use of recycled fiber in all systems. This results in a co-occurrence of stickies and pitch problems in a given mill.

Methods of preventing the build-up of deposits on the pulp and paper mill equipment and surfaces are of great importance to the industry. The paper machines could be shut down for cleaning, but ceasing operation for cleaning is undesirable because of the consequential loss of productivity, poor quality of the paper while the machine is partially contaminated and "dirt" which occurs when deposits break off and become incorporated in the sheet. Preventing deposition is thus greatly preferred where it can be effectively practiced.

One of methods to prevent pitch/stickies contaminants to deposit on papermaking equipment surfaces is to add various process aids into pulp slurry that contains pitch/stickies contaminants. For examples, a dispersant is added to pulp suspension to disperse and stabilize the contaminant particles, thus keeping them from deposition; or a detackifier is added to pulp suspension to render the contaminant particles less stickier, thus, less depositable; or a cationic polymer is added to pulp suspension to fix the contaminant particles onto fibers' surfaces, thus, removing them from the systems.

Another method to prevent pitch/stickies contaminants to deposit on papermaking equipment surfaces is to spray a deposit inhibitor on the papermaking equipment surfaces. Various deposit inhibitors have been invented to spray on surfaces of papermaking felts, forming wire, and press rolls. These deposit inhibitors either form a protective layer on the surfaces or change chemical properties of the papermaking equipment surfaces and make the surfaces less prone to the deposition of pitch/stickies contaminants.

U.S. Pat. No. 4,710,267 disclosed a process of reducing stickies contaminants in secondary fibers by adding a tertiary amine or quaternary ammonium cationic surfactant to the pulp after deinking but before sheet formation. U.S. Pat. No. 4,190,491 disclosed a process for preventing deposition of pitch by adding in a pulp suspension a cationic polymer derived from ethylenically unsaturated monomers. U.S. Pat. No. 4,765,867 disclosed to control pitch deposition by adding the pulp a quaternized polyamine ionene polymer. The polymer is derived from the condensation polymerization of epichlorohydrin with a dialkylamine. U.S. Pat. Nos. 5,223,097 and 5,626,720 disclosed to spray papermaking wires a quaternary polyamine which is a reaction product between an epichlorohydrin (EPI) and a dialkylamine.

U.S. Pat. No. 4,995,944 disclosed to apply papermaking felts a mixture of cationic polymer and a cationic surfactant. The cationic polymer is a dicyandiamide formaldehyde condensate polymer. U.S. Pat. Nos. 5,246,548 and 5,300,194 disclosed to apply a cationic polymer and a water dispersible anionic aromatic polymer to papermaking dryer fabrics. U.S.

Pat. No. 5,368,694 disclosed to apply the paper machine equipment surface a cationic polymer or a cationic surfactant while adding an anionic polymer or an anionic surfactant into pulp suspension to maintain an anionic charge in the suspension.

U.S. Pat. No. 4,956,051 disclosed to use a partially hydrolyzed polyvinyl alcohol to spray on the felts, wire, and press rolls of papermaking equipment. U.S. Pat. Nos. 5,723,021 and 5,952,394 disclosed to use a composition comprising a partially hydrolyzed polyvinyl alcohol, a gelatin, and a cationic polymer. The cationic polymer is a polyamine, a polyethyleneimine, or a copolymer of acrylamide and an ethylenically unsaturated amine U.S. Pat. No. 6,517,682 disclosed to apply a cationic polymer and a nonionic surfactant to papermaking felts. U.S. Pat. No. 7,534,324 disclosed to apply papermaking felts or equipment surface a nonionic polyoxyalkylene surfactant in which the polyoxyalkylene chains contain repeating units of both ethylene oxide (EO) and of a higher alkylene oxide (AO).

US patent application 2008/0029231 disclosed to apply papermaking systems including the surfaces of papermaking equipment a hydrophobically modified polyethylene glycol).

SUMMARY OF THE INVENTION

A method for inhibiting resinous and sticky substances from filling or forming deposits on or within papermaking forming wire, by applying to said wire an effective inhibiting amount of a composition comprising at least one cationic agent selected from the group consisting of (a) cationic polyureas, (b) hydrophobically modified cationic polymers, (c) alkylammonium or/and alkylimidazolium salts, and optionally further comprising at least one nonionic amphiphilic copolymer.

DETAILED DESCRIPTION OF THE INVENTION

A method for inhibiting resinous and sticky substances from filling or forming deposits on or within papermaking forming wire, by applying to said wire an effective inhibiting amount of composition comprising at least one cationic agent selected from the group consisting of (a) cationic polyureas, (b) hydrophobically modified cationic polymers, (c) alkylammonium or/and alkylimidazolium salts, and optionally at least one nonionic amphiphilic copolymer.

Unless otherwise specified all molecular weight given are number average molecular weights.

One embodiment of the present invention is to inhibit resinous and sticky substances from forming deposition on paper forming wire by applying an effective amount of a cationic polyurea (CPU) polymer. As used in the present invention, the term "cationic polyurea" refers to any cationic polymer that contains ureylene or N-substituted ureylene linkages in the polymer backbone. More specifically, the CPU polymers of the present invention have a general structure:

$$[—NR_3—CO—NR_3\text{-}A\text{-}]_f$$

wherein $R_3$ is hydrogen, alkyl, aryl, heteroaryl, substituted alkyl, substituted aryl, or substituted heteroaryl, and A is cationic repeating unit possessing one or more cationic charge when measure at a pH of 4 to 10 Preferably, the CPU of the present invention has a molecular weight in range from 1000 to 100,000. f is an integer and is selected to result in the desired molecular weight range. An exemplary CPU is bis(2-chloroethyl)ether-1,3-bis(3-(dimethylamino)propyl)urea copolymer and commercially available from Rhodia Incorporation (Cranbury, N.J., USA) under the trade name "Mirapol A-15".

Another embodiment of the present invention is to inhibit resinous and sticky substances from forming deposition on paper forming wire by applying an effective amount of a hydrophobically modified cationic polymer(s) (HMCP). As used in the present invention, the term "hydrophobically modified cationic polymers" refers to any water-soluble cationic polymer that contains hydrophobic groups distributed along its polymer chains. The hydrophobic groups impart surface activity to HMCP polymer chains and allow them the ability to absorb onto a hydrophobic surface such as paper forming wire through hydrophobic forces.

Examples of HMCPs useful in the present invention included, but are not limited to, hydrophobically modified poly(diallyldimethyl ammonium chlorides), hydrophobically modified poly(dimethylamoino ethyl acrylate), hydrophobically modified poly(dimethylamino methyl acrylamide), hydrophobically modified poly(acryloxy ethyl trimethyl ammonium chloride), chloride), hydrophobically modified poly(ethylene imine), hydrophobically modified poly(alkyl oxazolines), hydrophobically modified poly(vinyl amine), hydrophobically modified poly(vinylpyridines), hydrophobically modified polyamines-epichlorohydrin, hydrophobically modified polyaminoamides, hydrophobically modified polyamides-epichlorohydrin, et al.

A particularly preferred group of HMCPs suitable for use in this invention is a hydrophobically modified poly(aminoamide)s comprising randomly distributed units of formula (I):

(I)

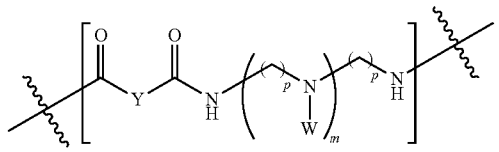

wherein W is a moiety selected from the group consisting of moieties of formulae (II), (III), (IV), (V), (VI), (VII), and (VIII):

(II)

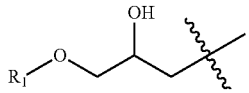

(III)

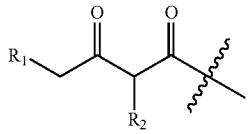

(IV)

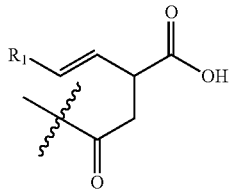

-continued (V)

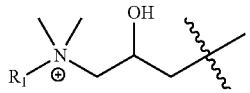

(VI)

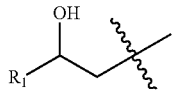

(VII)

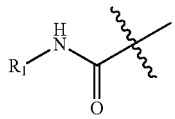

(VIII)

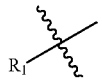

wherein $R_1$ and $R_2$, identically or differently, are a straight chain or branched aliphatic or olefinic or aromatic group having up to 22 carbon atoms and up to 4 double bonds, preferably having between 4 and 16 carbon atom; Y is a straight chain or branched aliphatic or olefinic group having up to 10 carbon atoms and up to 2 double bonds, and p and m are integers in the range of from 2 to 10. The number of randomly distributed units of formula (I) in the water-soluble, cationic polymer is in the range of from 5 to 10,000. The compositions disclosed in US patent application 2010/0147476 A1 are the illustrative of the hydrophobically modified poly(aminoamide)s of this invention.

Another particularly preferred group of HMCPs useful in this invention is a hydrophobically modified polyvinylpyrrolidones (HMPVP). More specifically, the HMPVP is selected from the group consisting of poly(vinylpyrrolidone-co-styrene) (PVP/S) and poly(vinylpyrrolidone-co-vinylacetate) (PVP/VA). Preferably, HMPVP is selected from the group of PVP/VA having the mole ratio of vinylpyrrolidone to vinylacetate (VP/VA) in the range from 95:5 to 50:50 and the molecular weight in the range from 10,000 to 500,000. An exemplary of the preferred PVP/VA of this invention is commercially available under trade name LUVITEC VA 64 from BASF Corporation (Florham Park, N.J., USA).

Another embodiment of the present invention is to inhibit resinous and sticky substances from forming deposition on paper forming wire by applying an effective amount of an alkylammonium salt or an alkylimidazolium salt.

A particularly preferred group of alkylammonium salts suitable for use in this invention has the general formula

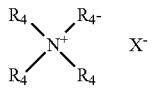

wherein each $R_4$ is independently selected from the group consisting of polyethylene oxide groups, polypropylene oxide groups, alkyl groups having between about 1 and 22 carbon atoms, aryl groups, aralkyl groups, and 2-hydroxyethyl, at least one of said $R_4$ groups being an alkyl group having at least about 8 carbon atoms and preferably an n-alkyl group having between about 12 and 16 carbon atoms; and wherein $X^-$ is an anion, typically a halide ion (e.g. chloride) Examples of this group include alkyl trimethyl ammonium salts, dialkyl dimethyl ammonium salts, alkyl dimethyl benzyl ammonium salts, alkyl hydroxyethyl dimethyl ammonium, alkyl bis(hydroxyethyl)methyl ammonium salts, and fatty amines. Mixtures of these compounds can also be used in this invention.

A particularly preferred group of imidazolium salts suitable for use in this invention has the general formula:

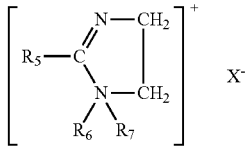

wherein $R_5$ is a C15-C21 acyclic aliphatic group, $R_6$ and $R_7$ are identically or separately, hydrogen, alkyl or hydroxyalkyl group and wherein $X^-$ is an anion, typically a halide ion (e.g. chloride) Examples of this group include, but are not limited to, 1-hydroxyethyl, 2-heptadecenyl imidazoline and 1-hydroxyethyl, 2 coco imidazoline.

Another embodiment of the present invention is to inhibit resinous and sticky substances from forming deposition on paper forming wire by applying an effective amount of a composition comprising at least one cationic agent of the invention and at least one non-ionic amphiphilic polymer (NIAP). The NIAP can comprise from 0 to 95% by dry weight of the composition. Preferably the NIAP comprises greater than 3%, or greater than 5% by dry weight of the composition.

As used in the present invention, the term "non-ionic amphiphilic polymer" refers to any water-soluble, or water-dispersible, polymer containing both hydrophilic and hydrophobic repeating units that are covalently bonded in the polymer chains.

One group of NIAP is copolymers of vinyl alcohol and vinyl alkonate (PVA/A). PVA/A is a general descriptor of a family of polymeric compounds based on having hydroxyl groups pendent to the polymer backbone which also contain some hydrophobic groupings such as acetate, propionate, butyrate, oleate and the like, but should not contain so much hydrophobic groupings as to render the polymeric material water insoluble. The PVA/A polymeric materials can have molecular weight ranges from about 1,000 to 250,000 or greater. These compounds are typically prepared from polymers or copolymers which yield the hydroxyl group on hydrolysis. The PVA/A which have been found most suitable in accordance to the present invention are those derived from poly[vinyl acetate] which have been from 50% to upwards of 100% hydrolyzed, preferably 70-99% hydrolyzed and has the molecular weight from about 2000 to 200,000 and preferably from 2,000 to 125,000.

The compositions disclosed in U.S. Pat. No. 4,871,424 are illustrative of the PVA/A compounds. In one embodiment of the invention the preferred PVA/A is derived from poly[vinyl acetate] with a nominal molecular weight of 100,000 and from about 70%-90% of the acetate groups have been hydrolyzed to hydroxyl groups.

Also illustrative of NIAP are hydrophobically modified poly[ethylene glycol] (HMPEG) composition comprising the formula:

$$(R_8—)_c—O—[—CH_2—CH_2—O—]_n—(—R_9)_d—Z \qquad \text{Formula 2}$$

wherein $R_8$ and $R_9$, identically or separately, are a hydrophobic moiety, or blocks of hydrophobic moieties of c and d repeat units, covalently bonded to poly[ethylene glycol]; n is 2 to 1200; c is 1 to 10; d is 0 to 10; Z is only present when d=0 and is hydrogen; the sum of c and d is greater than or equal to 2.

The hydrophobic moieties $R_8$ and $R_9$ of Formula 2 are formed after reaction of a poly[ethylene glycol] with a hydrophobic reagent known to those skilled in the art to be reactive with a primary alcohol. The hydrophobic reagent can be linear or branched, saturated or unsaturated, aliphatic or aromatic hydrocarbon radicals having from 2 to 100 carbon atom, or mixtures thereof. Exemplary compounds encompassed by $R_8$ and $R_9$ include, but are not limited to, alkenyl succinic anhydrides, such as n-octenylsuccinic anhydride; alkyl ketene dimers, such as lauryl ketene dimer; alkyl halides such as 2-ethylhexyl bromide; epoxides such as 1,2-epoxyhexane and 1,2-epoxydodecane; glycidyl ethers such as dodecyl glycidyl ether, 2-ethylhexyl glycidyl ether, butyl glycidyl ether, and 2-methyl phenyl glycidyl ether; carboxylic acids and their related acid chlorides or esters such as oleic acid, oleoyl chloride, and oleic acid methyl ester; mixtures of any of the foregoing and the like.

The compositions disclosed in U.S. Patent Application 2008/0029231 A1 are illustrative of HMPEG (hydrophobically modified poly[ethylene glycol]) compounds of this invention.

Another group of exemplary NIAP is hydrophobically modified cellulose ethers such as hydrophobically modified carboxymethyl cellulose (HMCMC), hydrophobically modified hydroxyethyl cellulose (HMHEC), hydrophobically modified hydroxypropyl cellulose (HMHPC), hydrophobically modified ethylhydroxyethyl cellulose (HMEHEC), hydrophobically modified carboxymethylhydroxyethyl cellulose (HMCMHEC), hydrophobically modified hydroxypropylhydroxyethyl cellulose (HMHPHEC), hydrophobically modified methyl cellulose (HMMC), hydrophobically modified methylhydroxypropyl cellulose (HMMHPC), hydrophobically modified methylhydroxyethyl cellulose (HMMHEC), hydrophobically modified carboxymethylmethyl cellulose (HMCMMC), mixtures of any of the foregoing and the like. Preferably the hydrophobically modified cellulose ether is hydrophobically modified hydroxyethyl cellulose (HMHEC).

HMHEC is a general descriptor of a family of chemical compounds that are based on hydroxyethyl cellulose (HEC) substrate and differ by what n-alkyl moieties are attached, the amount of hydrophobes, as well as the type of linkage between the cellulose substrate and the attached moiety. HMHEC is usually prepared from HEC by chemically incorporating a hydrophobic n-alkyl moiety generally having from 2 to more than 20 carbon atoms, onto the HEC. In one embodiment of the invention the hydrophobically modified hydroxyethyl cellulose (HMHEC) prior to hydrophobic modification has a degree of polymerization of about 75 to 1800. In another embodiment of the invention the hydrophobically modified hydroxyethyl cellulose (HMHEC) has hydrophobes between 10 and 24 carbon atoms in length. The hydrophobe can be linear or branched and is typically attached via an ester or ether linkage. The amount of hydrophobe incorporated will be dependent upon the intended use. The chemical and physical characteristics of HMHEC are determined by the number of carbon atoms in the hydrophobe, amount of hydrophobes, as well as the type of linkage that connects the hydrophobe to the HEC substrate.

The compositions disclosed in U.S. Pat. Nos. 4,228,277 and 6,054,511 are illustrative of HMHEC compounds of this invention. In one embodiment of the invention a preferred HMHEC is comprised of an ether linkage and a nominal $C_{16}$ hydrophobe.

Another group of exemplary NIAP of the present invention is the polyoxyalkylene block copolymers containing repeating units of both ethylene oxide (EO) and of a higher alkylene oxide (AO). AO carbons can range from 3 to 6. It is preferred that the AO groups are propylene oxide (PO) or butylene oxide (BO). It is most preferable that the higher alkylene oxide units in the polyoxyalkylene chains are PO.

According to the present invention, it is preferred that the polyoxyalkylene block copolymers have general formulas of $R_{10}$-EO-AO—$R_{11}$, $R_{10}$-AO-EO—$R_{11}$, $R_{10}$-EO-AO-EO—$R_{11}$, or $R_{10}$-AO-EO-AO—$R_{11}$, wherein $R_{10}$ and $R_{11}$ represent hydroxyl and hydrogen, respectively, and/or $R_{10}$ and $R_{11}$, identically or separately, can be a C1-C20 acid or alcohol to produce mono- or di-ester or ether links with the EO/AO block copolymer. Most preferably the block copolymers are triblock copolymers and containing the structure EO-PO-EO or PO-EO-PO, wherein the EO/PO mole ratio ranges from about 90:10 to 10:90 and such that the molecular weight of the block copolymers is from about 1000 to 20,000. Exemplary EO/PO block copolymers of the present invention are commercially available from BASF Corporation (Florham Park, N.J., USA) under the tradename of Pluronic.

Another group of exemplary MAP of the present invention is the hydrophilically modified polydimethylsiloxane polymers (HMPDMS). According to the present invention, HMPDMS is the polydimethylsiloxanes (PDMS) modified with hydrophilic moieties that either are grafted to the PDMS polymer chain or terminate the PDMS polymer chains at their one or both ends. Preferably, the hydrophilic moieties are selected from the group of polyoxyalkylene polymers containing repeating units of both ethylene oxide (EO) and of a higher alkylene oxide (AO), wherein AO carbons can range from 3 to 6. It is preferred that the AO groups are propylene oxide (PO), thus the polyoxyalkylene polymers used to modify PDMS have the structure of EO/PO and the EO/PO mole ratio in the range between 10/90 and 90/10.

According to the present invention, the HMPDMS of the present invention have the weight ratio of EO/PO segment to PDMS in range from 10:90 to 90:10 and such that the molecular weight of HMPDMS in the range from about 2000 to 100,000. More preferably, the EO/PO ratio is from about 30/70 to 70/30, and the molecular weight of HMPDMS is about 6000 to 35,000. Such polymers are commercially available from Dow Corning Corporation (Midland, Mich., USA) under the trade name of Dow Corning. Examples of particularly preferred HMPDMS with grafted EO/PO polyether chains include Dow Corning Q2-5247 with a molecular weight of 27,900 and a polyether chain having EO/PO ratio of 48/52 and Dow Corning 2-5573 with a molecular weight of 58,000 and 48/52 EO/PO ratio.

According to the invention, the composition of the invention has the ratio of the selected cationic agent to NIAP polymer in the range from 5:95 to 95:5 by weight, preferably in the range of 15:85 to 85:15, more preferably in the range of 35/65 to 65/35.

According to the invention, the composition of the invention is preferably sprayed on paper forming wire through any of the various aqueous low and/or high pressure cleaning or lubrication showers that are commonly used on the machine side and/or sheet side of the wire. The aqueous showers can be applied to the forming wire at a rate of about 0.01 to about 0.20 gallons per minute per inch width of wire. Preferably the concentration (by weight) of the compositions of the invention within the aqueous shower is from about 0.0001% to 1% (1 ppm to 10,000 ppm), more preferably, from about 0.001% to 0.2%.

The composition of the invention can also be used to treat other equipment surfaces in the papermaking or paper converting processes where deposition prevention is also important. Examples of such equipment surfaces include, wire return rolls, press rolls, press felts, lump-breaker rolls, couch rolls, calendar rolls, dryer cans, doctor blades, dryer fabrics, fabric carrier rolls, corrugating fluting rolls and printing presses. The composition can be applied to such surfaces using aqueous showers similar to the method described for the wire section. A preferred method of applying the compositions to these surfaces, particularly, those in the dry or converting sections would be to apply the compositions to the papermaking equipment surfaces undiluted using an atomized mist spray system.

EXAMPLES

Example 1

The invention is illustrated in the following examples, which are provided for the purpose of representation, and are not to be construed as limiting the scope of the invention.

| Identification | Descriptions |
|---|---|
| C | Presstige ® FP5500, polyamine cationic polymer |
| H1 | DETA based polyaminoamide modified with 10% C9 Hydrophobe* |
| H2 | TETA based polyaminoamide modified with 10% C9 Hydrophobe* |
| S1 | Cocobis hydroxyethyl, methyl ammonium |
| S2 | 50/50 mixture of alkyl dimethyl benzyl ammonium chloride and alkyl dimethyl ethyl benzyl ammonium chloride |
| S3 | Alkyl dimethyl benzyl ammonium chloride, |
| S4 | Cetyl trimethylammonium bromide |
| S5 | Tallow Amine |
| S6 | 1-Hydroxyethyl, 2-heptadecenyl imidazoline |
| S7 | 1-Hydroxyethyl, 2 coco imidazoline |
| U | Bis(2-chloroethyl) ether-1,3-bis(3-(dimethylamino)propyl) urea copolymer |

Note:
DETA: Diethylenetriamine
TETA: Triethylenetetraamine

Among the examples listed above, the example C is a commercial product of Hercules Incorporated, Wilmington, Del., USA and widely used in papermaking industry to inhibit resinous and sticky substances from forming deposition on paper forming wire. It is used as the control in the test for the purpose of comparison. The rest of samples are the materials of the present invention. The performance of the above examples for inhibiting resinous and sticky substances from forming deposition on paper forming wire is evaluated using a peel test as follows: A Mylar film is used to represent paper forming wire, and an adhesive type to represent resinous and sticky substances in papermaking systems. In the test, a Mylar film is submerged into water that contains either 154 μeql/L anionic charge or no anionic charge. The anionic charge (AC) in the solution consists of sodium lignosulfonate, abietic acid and oleic acid at the weight ratio of 100:84:16 and was measured using Mütek PCD02 (Mütek Analytic GmbH, Herrsching, Germany). Then, an amount of 15 ppm of the testing materials, on dry weight basis, is added and continued to mix for 5 minutes. After the treatment, the Mylar film is removed from the test water and attached to the adhesive tape. Then a peel force tester is employed to measure the peel force that is required to remove the tape from the Mylar film. The peel force thus measured is correlated to the tendency of resinous and sticky substances to deposit on paper forming wire in papermaking machine. The lower peel force means the lower tendency that that resinous and sticky substances will deposit on paper forming wire, vice versa. The test results are listed in the Table 1.

TABLE 1

| | Peel force, lb | |
|---|---|---|
| Examples | 154 μeql/L AC | 0 μeql/L AC |
| 15 ppm C | 1.7 | 4.33 |
| 15 ppm H1 | 0.49 | 3.49 |
| 15 ppm H2 | 0.15 | 3.20 |
| 15 ppm S1 | 0.60 | 3.99 |
| 15 ppm S2 | 0.41 | 4.11 |
| 15 ppm S3 | 0.76 | 3.84 |
| 15 ppm S4 | 0.12 | 4.02 |
| 15 ppm S5 | 0.55 | 4.15 |
| 15 ppm S6 | 1.32 | 1.76 |
| 15 ppm S7 | 1.48 | 2.40 |
| 15 ppm U | 0.00 | 4.08 |

As can be seen, in the water of 154 μeql/L AC, the two hydrophobically modified cationic polymers (sample H1 and H2), the quaternary ammonium cationic surfactants (samples S1 to S5), and the cationic polyurea (sample U) considerably outperform the control. In the water of 0 μeql/L AC, the two alkyl imidazoline cationic surfactants (samples S6 and S7) and the samples H1 and H2 also outperform the control.

Example 2

This example demonstrates the synergistic effect of the composition of the invention that combines a nonionic amphiphilic polymer and a cationic surfactant on inhibiting resinous and sticky substances from forming deposition on paper forming wire. Three samples used in the demonstration are described as follows:

| Identification | Descriptions |
|---|---|
| S6 | 1-Hydroxyethyl, 2-heptadecenyl imidazoline |
| E1 | Polyethylene glycol modified with 25% C8 hydrophobe |
| B | 50% S6 + 50% E |

The peel test as described in Example 1 is employed to compare the performance of the above three materials. The test is conducted in a water containing 0 μeql/L AC and at the concentrations of 10 ppm and 20 ppm testing materials, on dry weight basis. The results of the peel test in are listed in Table 2. As can be seen, the sample B has a lower peel force than the sample E or S6 when they are used alone. The results in Table 2 clearly demonstrate that the combination of the samples E and S6 produces a synergistic effect on protecting paper forming wire from deposition of pitch/stickies contaminants.

TABLE 2

| | Peel force, lb (0 μeql/L AC) | |
|---|---|---|
| Examples | @10 ppm | @20 ppm |
| S6 | 1.58 | 1.28 |
| E1 | 1.59 | 2.3 |
| B | 0.96 | 0.3 |

Example 3

In this example, a sample, designated as E2, is created according to the present invention by combining a cationic agent of the invention and a NIAP according to the present invention. The cationic agent used in this example is the cationic polyurea U as described in the Example 1 and the MAP used is a copolymers of vinyl alcohol and vinyl alkonate (PVA/A) that has a degree of hydrolysis of around 87% and a molecular weight of about 150,000. The sample E1 has its active solid consisting of 75 wt % of U and 25 wt % of the PVA/A. The peel test as described in Example 1 is employed to compare the performance of E2 with U on inhibiting resinous and sticky substances from forming deposition on paper forming wire. The test is conducted in a water containing 0 μeql/L AC and at the concentrations of 2.5 ppm and 10 ppm testing materials, on dry weight basis. The results of the peel test in are listed in Table 3. As can be seen, the sample E2 demonstrates a lower peel force than the sample U at the both concentrations, suggesting that the composition of the sample E2 is more effective than U for inhibiting resinous and sticky substances from forming deposition on paper forming wire at the zero anionic charge condition.

TABLE 3

| | Peel force, lb (0 μeql/L AC) | |
|---|---|---|
| Examples | @2.5 ppm | @10 ppm |
| U | 4.3 | 4.0 |
| E2 | 3.7 | 1.2 |

The invention claimed is:

1. A method for inhibiting resinous and sticky substances from filling or forming deposits on or within papermaking forming wire, by applying to said wire an effective inhibiting amount of composition comprising at least one cationic agent, wherein the at least one cationic agent is selected from the group consisting of (a) cationic polyureas, wherein the cationic polyureas comprises bis(2-chloroethyl) ether-1,3-bis(3-(dimethylamino)propyl)urea copolymer and has a molecular weight in the range of from 1000 to 100,000, (b) hydrophobically modified cationic polymers, (c) alkylammonium or/and alkylimidazolium salts, and optionally, further comprising at least a non-ionic amphiphilic polymer; and wherein the composition is sprayed on paper forming wire through at least an aqueous low and/or high pressure cleaning or lubrication shower on the machine side and/or sheet side of the wire at a concentration in said shower water from about 1 ppm to 10000 ppm and at a rate of about 0.01 to about 0.20 gallon shower water per minute per inch width of wire.

2. The method according to claim 1 wherein the cationic polyureas have a general structure:

$$[—NR_3—CO—NR_3\text{-}A\text{-}]_f$$

wherein $R_3$ is hydrogen, alkyl, aryl, heteroaryl, substituted alkyl, substituted aryl, or substituted heteroaryl, and A is cationic repeating unit possessing one or more cationic charge when measure at a pH of 4 to 10.

3. The method according to claim 1 wherein the hydrophobically modified cationic polymers are hydrophobically modified poly(aminoamide)s comprising randomly distributed units of formula (I):

(I)

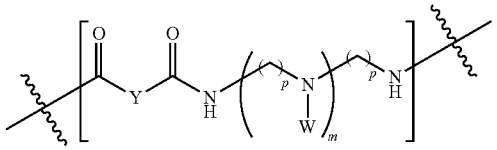

wherein W is a moiety selected from the group consisting of moieties of formulae (II), (III), (IV), (V), (VI), (VII), and (VIII):

wherein $R_1$ and $R_2$, identically or differently, are a straight chain or branched aliphatic or olefinic or aromatic group having up to 22 carbon atoms and up to 4 double bonds, preferably having between 4 and 16 carbon atom; Y is a straight chain or branched aliphatic or olefinic group having up to 10 carbon atoms and up to 2 double bonds, and p and m are integers in the range of from 2 to 10; the number of randomly distributed units of formula (I) in the hydrophobically modified cationic polymer is in the range of from 5 to 10,000.

4. The method according to claim 1 wherein the alkylammonium salts have the general formula

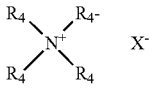

wherein each R4 is independently selected from the group consisting of polyethylene oxide groups, polypropylene oxide groups, alkyl groups having between about 1 and 22 carbon atoms, aryl groups, aralkyl groups, and 2-hydroxyethyl, at least one of said R4 groups being an alkyl group having at least about 8 carbon atoms and preferably an n-alkyl group having between about 12 and 16 carbon atoms; and wherein $x^-$ is an anion.

5. The method according to claim 1 wherein the alkylimidazolium salts have the general formula

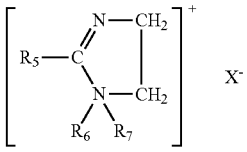

wherein $R_5$ is a C15-C21 acyclic aliphatic group, $R_6$ and $R_7$ are, identically or separately, a hydrogen, an alkyl or a hydroxyalkyl group and $x^-$ is an anion.

6. The method according to claim 1 wherein the optional non-ionic amphiphilic polymer is selected from the group consisting of (i) hydrophobically modified poly[ethylene glycols], (ii) hydrophobically modified cellulose ethers, (iii) copolymers of vinyl alcohol and vinyl alkonate, (iv) polyoxyalkylene block copolymers; and (v) hydrophilically modified polydimethylsiloxanes.

7. The method according to claim 6 wherein the hydrophobically modified poly[ethylene glycol] composition comprising the formula:

$$(R_8—)_c—O—[—CH_2—CH_2—O—]_n—(—R_9)_d—Z$$

wherein $R_8$ and $R_9$ are a hydrophobic moiety, or blocks of hydrophobic moieties of c and d repeat units, covalently bonded to poly[ethylene glycol]; n is 2 to 1200; cis 1 to 10; d is 0 to 10; Z is only present when d=0 and is hydrogen; the sum of c and d is greater than or equal to 2.

8. The method according to claim 6 wherein the vinyl alcohol polymer containing hydrophobic groups is derived from polyvinyl acetate which has been 70-99% hydrolyzed and has the weight average molecular weight from about 2,000 to 200,000.

9. The method according to claim 6 wherein the hydrophobically modified cellulose ether is hydrophobically modified hydroxyethyl cellulose (HMHEC) which has hydrophobes between 10 and 24 carbon atoms in length.

10. The method according to claim 6 wherein the hydrophobically modified cellulose ether is hydrophobically modified hydroxyethyl cellulose (HMHEC) which has a degree of polymerization of about 75 to 1800 prior to hydrophobic modification.

11. The method according to claim 6 wherein the polyoxyalkylene block copolymers comprise repeating units ethylene oxide (EO) and propylene oxide (PO) and are triblock copolymers having the structure EO-PO-EO or PO-EO-PO, wherein the EO/PO mole ratio ranges from about 90:10 to 10:90 and the weight average molecular weight ranges from about 1000 to 20000.

12. The method according to claim 6 wherein the hydrophilically modified polydimethylsiloxanes are the polydimethylsiloxanes (PDMS) grafted with ethylene oxide (EO) and propylene oxide (PO) polyester, wherein the EO/PO mole ratio is in the range between 10/90 and 90/10 and the molecular weight in the range from about 2000 to 100,000.

13. The method according to claim 1 wherein the composition has a ratio of cationic agents to non-ionic amphiphilic polymers in the range of from 5:95 to 95:5 by dry weight.

* * * * *